United States Patent [19]

Sjöstrand

[11] 4,258,603

[45] Mar. 31, 1981

[54] PLUCKING MECHANISM FOR A STRINGED INSTRUMENT

[76] Inventor: Gunnar Sjöstrand, Önhult, Box 268 A, 597 00 Åtvidaberg, Sweden

[21] Appl. No.: 38,858

[22] Filed: May 14, 1979

[30] Foreign Application Priority Data

May 17, 1978 [SE] Sweden ..... 7805621

[51] Int. Cl.[3] ..... G10C 3/16

[52] U.S. Cl. ..... 84/258; 84/321

[58] Field of Search ..... 84/8–9, 84/224, 258, 320, 321

[56] References Cited

U.S. PATENT DOCUMENTS

| | | | |
|---|---|---|---|
| 593,072 | 11/1897 | Ackermann | 84/320 |
| 673,027 | 4/1901 | Parduba | 84/320 |
| 3,525,283 | 8/1970 | Pavia | 84/173 |

FOREIGN PATENT DOCUMENTS

| | | | |
|---|---|---|---|
| 735226 | 11/1932 | France | 84/258 |
| 1239654 | 7/1971 | United Kingdom | 84/258 |

*Primary Examiner*—Lawrence R. Franklin

*Attorney, Agent, or Firm*—Fisher, Christen & Sabol

[57] ABSTRACT

A plucking mechanism for a string instrument, for instance a harpsichord consists of a mandrel directly coupled to the key, the mandrel being provided with a protruding edge which plucks the string.

5 Claims, 3 Drawing Figures

PLUCKING MECHANISM FOR A STRINGED INSTRUMENT

The present invention refers to a plucking mechanism for a stringed instrument at which the pressing down of a key causes a sound from a string by means of plucking the string with a pointed means.

During several centuries the plucking mechanics in the above described type of string instrument which for instance could be a harpsichord has in principle not been subject to any essential changes in design. The plucking of the string is thus achieved by coupling the key to the pointed means which plucks the string via a considerable number of links and arms with appertaining frictional points which require continuous service and where the harpsichord players often have to carry out adjustments themselves in order to make the plucking mechanisms work satisfactory. In these mechanisms changes continuously appear, which changes increase or decrease the distance between the pointed means and the string which causes variation in intensity and timbre.

It is an object of the present invention to achieve a plucking mechanism which uses modern construction material and modern production technique and which thus makes the mechanism substantially cheaper and more reliable as compared to the previously used design. The characteristics of the invention will appear from the claims attached to the specification.

In the plucking mechanism according to the invention the moveable parts are replaced by one single part which almost completely eliminates position changes and causes a constant intensity and timbre, an almost soundless playing function, a decreased wearing and an improved plucking of spun strings by replacing the traditional pin by a broader and more elastic tone generating means.

Figure 1:
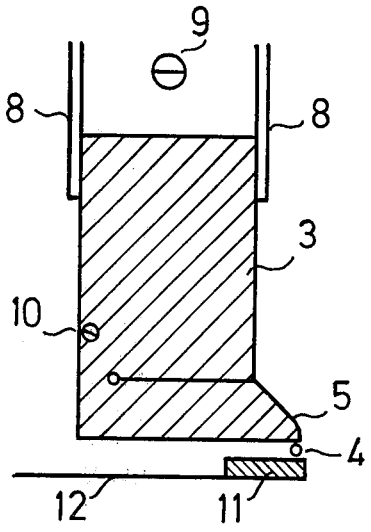
Figure 2:
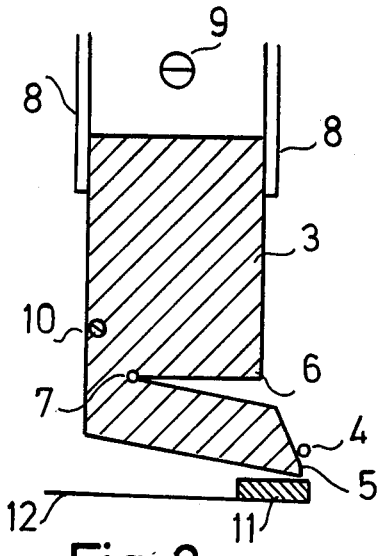
Figure 3:
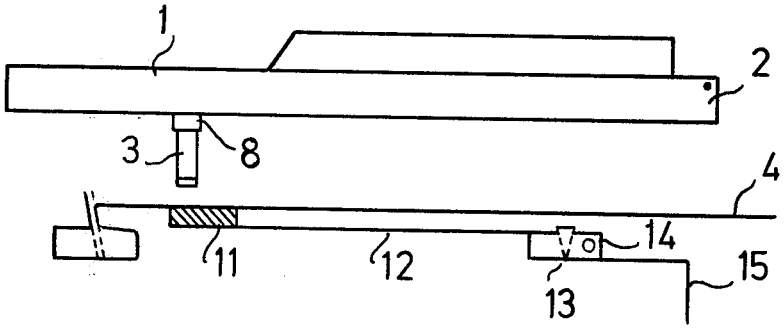

The invention will now be described in detail, reference being made to the attached drawing in which:

FIGS. 1 and 2 show a cross-sectional view through the plucking mechanism according to the invention; the mechanism being in its rest position in FIG. 1, and in FIG. 2 being shown just prior to returning fully to its rest position after having plucked a string and FIG. 3 is a longitudinal sectional view through the plucking mechanism according to the invention with its appertaining keyboard.

In FIGS. 1 and 2, reference 3 denotes the plucking means, the so called mandrel, which is attached to a key denoted 1 in FIG. 3, said key being journalled on an axis 2. When the key is forced downwards the lower protruding edge 5 of the mandrel plucks string 4 and initiates a vibrating of the string. The mandrel should be made of a relatively soft material for instance rubber with a degree of hardness of about 70 Shore. The string will thereafter vibrate as long as the key is in its lower position. When the key returns to its rest position the pointed part of the mandrel will again touch the string but since the mandrel is provided with a slot 6 the string will only be touched smoothly and will not be brought into a vibrating state. In order not to risk an extension of the slot 6 the mandrel should be provided with a bore 7 at the inner end of the slot.

In order to make an adjustment of the distance between the mandrel and the string the socket 8 is provided with a screw 9 by means of which the mandrel is vertically displaceable. The mandrel could also be provided with a bore 10 in which a conical screw is inserted so that when the screw is introduced into the mandrel the soft parts around the screw are expanded whereby the pointed end 5 of the mandrel is brought closer to the string so as to achieve an increased intensity.

As the mandrels are mounted on top of the strings dampers 11 can be located below the strings whereby the same effects can be achieved as in a grand piano, i.e. firstly an individual damping of each string and secondly a simultaneous release of all strings. As appears from FIG. 3 the mandrel 3 will release the string 4 from the damper 11 when the string is brought downwards, said damper being attached to a plate spring 12. Simultaneously all strings can be released from their dampers by mounting all the dampers on a common rod 13 journalled at 14 whereby by means of a pedal rod 15 all damper can be controlled simultaneously in a traditional way. This system will make new timbres possible in the harpsichord by means of coupled vibrations from other strings which is especially important in figurations within the same chords.

A further advantage of the invention is that the improved functional precision implies a possibility of designing the complete keyboard with the plucking means in such a way that it is sidewise displaceable which permits changes in the distance between the string and the plucking mechanism.

It should also be noted that the plucking mechanism can be located under the strings and thus on top of the keys.

We claim:

1. A plucking mechanism for a stringed instrument of the type where a key is mounted for movement between first and second positions, said plucking mechanism comprising a block of soft material fixedly secured at one end to said key, said block being partially severed adjacent the other end in a generally horizontal direction inwardly from one side of said block to form a slot therein, a transversely outwardly projecting extremity disposed at said other end and extending in the direction of said one side, said projecting extremity having a first surface for plucking a string as said key is moved from said first to said second position, and said projecting extremity having a second surface adjacent said slot for deflecting said projecting extremity around said string in a non-plucking manner as said key moves from said second to said first position.

2. A plucking mechanism according to claim 1 wherein said second surface tapers from said slot outwardly toward said first surface.

3. A plucking mechanism according to claim 2 wherein a screw having a conical head is threadedly embedded in said block adjacent said other end and adjacent the side of said block opposite said one side to vary the position of said projecting extremity.

4. A plucking mechanism according to claim 3 wherein a socket is mounted on said key and said one end of said block is vertically adjustably mounted in said socket.

5. A plucking mechanism according to claim 4, wherein the degree of hardness of said soft material is approximately 70 Shore.

* * * * *